United States Patent [19]

Säufferer et al.

[11] 4,034,728

[45] July 12, 1977

[54] INSTALLATION FOR ACHIEVING AN AIR/FUEL MIXTURE

[75] Inventors: Helmut Säufferer, Esslingen; Karl Willmann, Aichwald, both of Germany

[73] Assignee: Daimler-Benz Aktiengesellschaft, Germany

[21] Appl. No.: 539,830

[22] Filed: Jan. 9, 1975

[30] Foreign Application Priority Data

Jan. 10, 1974 Germany ..... 2401047

[51] Int. Cl.[2] ..... F02B 51/04

[52] U.S. Cl. ..... 123/119 E; 123/141

[58] Field of Search ..... 123/141, 119 E

[56] References Cited

U.S. PATENT DOCUMENTS

| | | | |
|---|---|---|---|
| 1,771,626 | 7/1930 | Hamilton | 123/119 E |
| 2,310,306 | 2/1943 | Miller | 123/119 E |
| 3,110,294 | 11/1963 | Nyman | 123/119 E |
| 3,266,783 | 8/1966 | Knight | 123/119 E |

*Primary Examiner*—Ronald H. Lazarus

*Attorney, Agent, or Firm*—Craig & Antonelli

[57] ABSTRACT

An installation for producing an air/fuel mixture for a mixture-aspirating internal combustion engine, which includes a fuel atomizer equipped with at least one fuel nozzle terminating in the air guide channel and traversed by the sucked-in air; certain surfaces arranged in the flow path of the mixture are thereby at different electric potentials whereby an electrode electrically insulated with respect to the fuel nozzle or nozzles is arranged in front of each of the nozzles with the potential difference applied between the electrode, on the one hand, and the fuel nozzle on the other.

64 Claims, 2 Drawing Figures

INSTALLATION FOR ACHIEVING AN AIR/FUEL MIXTURE

Figure 1:
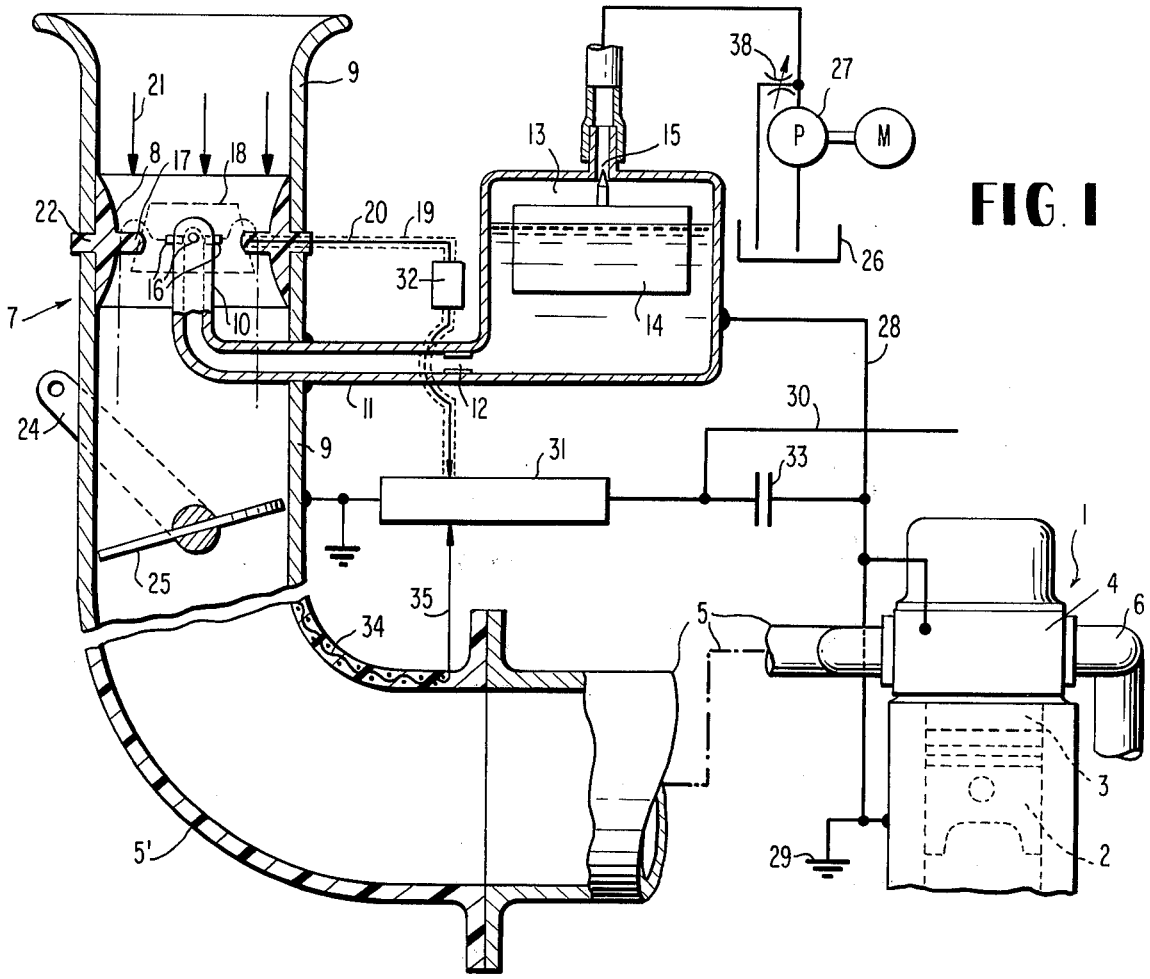

The present invention relates to an installation for the production of an air/fuel mixture for a mixture-aspirating internal combustion engine, with a fuel atomizer provided with at least one fuel nozzle terminating in the air conducting channel and traversed by the sucked-in air and with surfaces at different electrical potentials arranged in the flow path of the mixture.

Such an installation is known in the art, for example, as disclosed in the German Offenlegungsschrift 2,319,544.

In this known prior art installation an air/fuel mixture produced by an atomizer carburetor of customary construction is conducted through an electric field at least approximately in the direction of equipotential surfaces.

With a sufficiently high field strength, a point is reached with predetermined droplet size, at which the separating electrostatic forces predominate over the cohesive forces on the basis of the surface tension; the droplet then decomposes into at least two smaller droplets in which by reason of the smaller droplet diameters the cohesive forces based on surface tension then predominate again with respect to the electrostatic forces. During the flow of the air/fuel mixture produced in the customary, prior art carburetor through the electrostatic field, the droplet size is thus reduced and therewith the mixture is improved. By reason of the smaller droplet size, the same evaporate and combust more rapidly and the combustion of such a mixture produces a better fuel exploitation and improved exhaust gases. Consequently, only the quality of the air/fuel mixture as regards its homogeneity is influenced by the arrangement of the electrostatic field according to customary, prior art fuel carburetors. The quantity of the air/fuel mixture, however, remains dependent in the known installation, as before, on those possibilities of the prior art fuel carburetors which are partly inadequate, i.e., the air/fuel ratio of the mixture cannot be matched in an optimum manner to all operating conditions.

It is the aim of the present invention to teach how not only the mixture quality of a mixture-producer is improved, but also how the mixture ratio can be influenced by a further possibility of influencing the same.

The underlying problems are solved according to the present invention in that an electrode, preferably porous or permeable to air flow, is arranged in the fuel atomizer at a distance from each fuel nozzle, which electrode is mounted electrically insulated with respect to the fuel nozzle or nozzles of the atomizer, and in that the aforementioned potential difference is applied between the electrode or electrodes, on the one hand, and the fuel nozzles, on the other.

According to the present invention, the two droplet-producing phenomena, namely air stream and electric field are thereby arranged functionally parallel adjacent one another at the location where the fuel droplets originate. Both influences are variable independently of one another and one is able correspondingly to exert thereby an influence on the mixture ratio of the mixture in different ways, namely, on the one hand, by the magnitude of the suction air stream and, on the other, independently of the former, by the electrostatic field. The droplets thereby move as to the rest essentially transversely to the equipotential surfaces of the electrostatic field. The field strength of the electrostatic field between the nozzle or nozzles and the electrode or electrodes is therefore appropriately constructed to be variable, especially is constructed to be variable as a function or according to an indication of at least one of the operating magnitudes of the engine. This can take place either in that the applied potential is changed or that the distance between the nozzle or nozzles and associated electrode is varied. Both possibilities can be used either individually or in common. Thanks to the possibility according to the present invention, one may dispense with equipping so-called carburetors of customary, prior art construction with complicated additional nozzle- and channel-systems for enriching or leaning the mixture under certain operating conditions. This function can be assumed by the electrostatic field between the fuel nozzles and the electrodes. The mixture adaptation and optimization as regards the different operating conditions, for example, high traction at medium or high rotational speed or pushing operation, can take place by a simple field strength variation, for example, by changing the tap or moving the arm of a potentiometer. The mixture producers may therefore be constructed considerably more simple than heretofore with the same or better functioning capability.

The mixture quantity and the quality can be additionally influenced especially, for example, during engine starting, in that at least two nozzles or groups of nozzles preferably of differing opening cross section are provided and in that the nozzles are adapted to be connected either additionally or alternatively with the fuel supply. This is so as the droplet size of the mixture, i.e., the mixture quality is influenced decisively by the nozzle section. On the other hand, by a distribution of the entire nozzle cross section over a larger number of nozzles, the flow resistance thereof is increased and thus the mixture is influenced from a quantitative point of view. With otherwise identical conditions, the distribution of the nozzle cross section over a larger number of nozzles thus signifies a leaning of the mixture connected with a mixture improvement and vice versa.

Appropriately the fuel nozzles together with the other electrically conducting component parts of the fuel atomizer and of the internal combustion engine are placed at the same potential. This dispenses with a separate electrical insulated arrangement of the nozzles of the carburetor and the customary electrically conducting carburetor materials can be used.

In order to be able to realize the present invention with as few changes as possible in hitherto customary atomizer carburetors, provision is made that several fuel nozzles are arranged in the air-conducting channel of the fuel atomizer along a closed line with opening normals preferably directed from the inside toward the outside (nozzle ring), whereby the opening normal of each nozzle is arranged at an obtuse or right angle to the inflow direction or initial direction of flow of the air and in that the electrode is constructed as a flow-permeable or porous basket, cage, sieve or the like (electrode basket) extending in front of each nozzle of the nozzle ring. According to the preferred embodiment, the nozzles are arranged radially star-shaped at the so-called carburetor stock or trunk which is surrounded by an electrode basket.

In order to disturb as little as possible the droplet jets which are discharged out of the nozzles and move toward the electrode baskets, it is advisable to select the shadow areas of the electrode basket as small as possible in relation to the opening area of all meshes and to preferably construct the mesh size of the electrode basket considerably larger than the opening width of the nozzles. It also serves the goal to disturb as little as possible the droplet trajectory through the electrode basket if the latter is so constructed and arranged relative to the nozzle ring that the opening normal of each nozzle encounters the opening of a mesh of the electrode basket.

Appropriately, the electrode basket is retained by way of at least one radially arranged arm, preferably by way of two or three arms of electrically non-conducting material, preferably of synthetic resinous material of conventional type. It is thereby advantageous if the electrically conducting connection between the voltage source for the potential of the electrode basket and the electrode basket itself (voltage feed) is extended through one of the support arms. It is recommended according to the present invention to shield the voltage feed to the electrode basket. For safety reasons, an ohmic resistance is arranged in the voltage feed which has a very high ohmic resistance. The electric currents are limited thereby and an unintentional spark-over in the carburetor is prevented.

The electrode basket may be constructed cylindrically with generatrices pointing in the direction of the air flow. However, it may also be constructed at least in coarse approximation conically shaped with a cone axis disposed parallel to the air flow. This construction offers the advantage that the distance between the electrode and the nozzle can be changed by the axial displacement of one of these parts. It may therefore be of advantage to construct the electrode basket and/or the nozzle ring so as to be axially displaceable in the flow direction. In order to achieve a good mixing of the formed droplets with the suction air, in order to increase the relative velocity between droplets and suction air and in order to obtain as fine an atomization or vaporization as posible, it is advisable to arrange the conically shaped electrode basket to point with its cone apex opposite the flow direction of the suction air. However, the nozzle opening normals are thereby arranged perpendicularly to the flow direction. The droplets then receive a small flight component directed opposite the air flow.

With the described arrangement of the mixture producer, the droplets receive an electrostatic charge which corresponds in its sign to the direction of the potential difference between the nozzle and the electrode. Since the droplets are also charge carriers, their flight or trajectory can be influenced by electrostatic forces. In order to reduce a coagulation of the droplets by impingement against walls during flow deflections or the like, it is appropriate that electrodes are mounted within the area of elbows of the mixture lines leading to the combustion spaces of the internal combustion engine, which are connected to an electric potential such that an electrostatic force directed toward the center of the curvature acts on the droplets.

Accordingly, it is an object of the present invention to provide an installation for producing an air/fuel mixture which avoids by simple means the aforementioned shortcomings and drawbacks encountered in the prior art.

Another object of the present invention resides in an installation for producing an air/fuel mixture in which the air/fuel mixture can be influenced not only as regards its homogeneity but also as regards its air/fuel ratio.

A further object of the present invention resides in an installation for producing an air/fuel mixture in which the air/fuel ratio can be matched in an optimum manner to all operating conditions without sacrifice in the combustion processes.

Still a further object of the present invention resides in a air/fuel mixture producer in which the two variables, namely, air stream and electric field, can be varied independently of one another and thus can be used independently of one another to influence the mixture.

Another object of the present invention resides in a mixture producer of the type described above which can be constructed considerably more simple than heretofore with the same or improved functioning capability.

Still another object of the present invention resides in a mixture producer of the type described above, in which relatively few changes have to be made in the present-day customary carburetor constructions to attain the advantages of the present invention.

Still a further object of the present invention resides in a mixture producer for producing an air/fuel mixture for internal combustion engines in which an electric field is effectively used, yet the danger of arcing-over is completely eliminated.

Another object of the present invention resides in a mixture producer which not only achieves a good mixing of the formed small droplets with the suction air but which also prevents a re-coagulation of the droplets as a result, for example, of impingement thereof against the walls in elbows and the like of the intake line.

Figure 2:
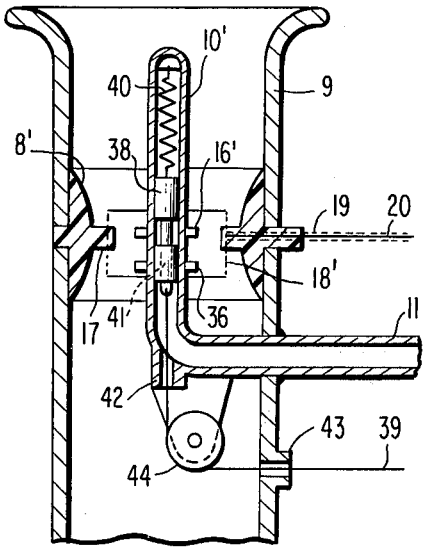

These and further objects, features and advantages of the present invention will become more apparent from the following description when taken in connection with the accompanying drawing which shows, for purposes of illustration only, two embodiments in accordance with the present invention, and wherein:

FIG. 1 is a somewhat schematic cross-sectional view through a gasoline atomizer in accordance with the present invention which is constructed in a particular simple manner, and its coordination to an internal combustion engine in accordance with the present invention; and FIG. 2 is a partial cross-sectional view through a modified embodiment of a simplified gasoline atomizer in accordance with the present invention.

Referring now to the drawing wherein like reference numerals are used throughout the two views to designate like parts, and more particularly to FIG. 1, an internal combustion engine generally designated by reference numeral 1 is illustrated in this figure which includes a piston 2, a working space 3, a cylinder head 4, a suction pipe 5, and an exhaust pipe 6. A fuel atomizing installation generally designated by reference numeral 7 belongs to the engine 1. The fuel atomizing installation 7 includes a main pipe 9 provided with an insert 8 increasing the flow velocity; the carburetor tube, i.e., the so-called carburetor trunk 10 is arranged coaxially in the main pipe 9, and more particularly within the insert 8 thereof. The carburetor trunk 10 is supplied with gasoline from the float chamber 13 which includes a float 14 and a float valve 15, by way of the line 11 and the nozzle 12, whereby the gasoline is able to enter into the atomizing zone by way of the ring of radially arranged atomizing nozzles 16.

The insert 8 is constructed in the illustrated embodiment of electrically well-insulating synthetic resinous material of conventional type and is provided with arms 17 which are constructed streamlined as viewed in cross section. The arms 17 carry a conically shaped wide mesh basket 18 made of a braidwork, network or fabric of thin metallic wire. The mesh sizes may be selected to suit any particular construction for example, may be of a size of about 1 mm. to about 5 mm.; however, they may also differ therefrom, the only requirement of the mesh size is that it is sufficiently large that the basket offers no significant flow resistance yet is sufficiently small that the basket is sufficiently form-rigid. A metallic electrically conducting conductor 20 connected with the basket 18 and provided with a shielding 19, is extended out of the inside of the pipe 9 by way of the interior of an arm 17. The basket 18 is arranged concentrically to the nozzle ring 16 and the cone apex points opposite the flow direction indicated by arrows 21. Pins 22 are arranged on the outside of the insert 8 which retain the same in the pipe wall.

A throttle valve 25 which can be pivoted by means of the lever 24 and which is arranged in the main pipe 9, is additionally provided— as usual—in the atomizer installation 7. The float chamber 13 which supplies the carburetor trunk 10 with gasoline is filled with fuel by the gasoline pump 27 sucking the fuel out of the tank 26 by way of the needle valve 15. In case the needle valve 15 closes, the supply of the gasoline pump 27 flows back into the tank or into the suction connection of the pump by way of the throttle 38.

The main pipe 9 is electrically connected with the remaining metallic parts of the atomizer installation, especially with the float chamber 13 and the nozzles 16. The metal parts of the atmomizer installation 7 and of the engine 1 are connected with the electrically conducting mass 29 of the vehicle, constituting the ground, by way of the ground line 28, i.e., are brought to the electric potential of zero. An ohmic resistance 31 and a condenser 33 of very high break-down voltage and high capacity are connected in parallel between the ground line 28 and the charging line 30; the condenser 33 serves as high voltage source. The condenser 33 is pulsatingly charged or kept charged by way of the charging line 30 from a pulse generator of conventional type (not shown) which, for example, similar as required for the mixture ignition, produces voltage pulses of high voltage. The resistance 32 in the line 20 serves the purpose of limiting the current flowing out of the condenser 33 to such low values that the formation of an arc in the atomizer installation is avoided with certainty. The resistance 31 serves the adjustment of the voltage or the fixed potential tap for different places inside of the installation.

An electrode 34 which is electrically insulated with respect to the metallic parts of the installation is arranged in the elbow 5′ of the suction line along the inner side of the curvature. This electrode 34 represents a wide mesh braidwork, plaitwork, network or fabric of thin wires; it is molded, e.g., injection molded, into the wall of the elbow member 5′ made of electrically well-insulating synthetic resinous material along the inner side of the curvature. The electrode 34 is provided with a voltage feed line 35 which is connected to a place or tap of the resistance 31. As a result thereof, the electrode 34 can be placed at an electrostatic potential which exerts radially inwardly directed forces reducing wall impingements onto the charged droplets flowing past the same.

The operation of the atomizer installation is now as follows:

As a result of the downward movement of the piston 2 within the working space 3, air is sucked in through the main pipe 9 of the atomizer installation 7 when the throttle valve 25 is opened. As already known with the customary carburetors—gasoline is sucked out of the nozzles 16 by the vacuum caused by the air flow (arrows 21) proceeding transversely to the nozzle opening and is immediately atomized in the air flow. Owing to the high electrostatic potential applied to the electrode basket 18 which is disposed opposite the nozzle 16, this discharge of fuel out of the nozzles 16 and the atomization thereof into small droplets is favored. Three effects are essentially responsible therefor: the applied electrostatic field effects, on the one hand, a decrease of the effective surface tension and smaller nozzle diameters can thus be used whereby the discharge size of the droplets is very small. On the other hand, the formed droplets are charged for the most part and therefore have a tendency for further decomposition or splitting up. Moreover, the relative velocity of the primary droplets with respect to the air flowing past is increased. These effects may be so strong that also with very small flow velocities a rich and finely atomized mixture can be formed. The electrostatic atomizing effect can be influenced by changing the field strength of the electrostatic field which will establish itself between the electrode baskets and the nozzle ring. In the illustrated embodiment, this can take place by changing the point of tap or engagement of the voltage supply line 19 along the resistance 31.

Another type of construction of an atomizer installation according to the present invention which illustrates a further possibility of influencing the atomizing action, is illustrated in FIG. 2. Far-reachingly corresponding parts are thereby designated with the same reference numerals as in FIG. 1 whereas similar and functionally corresponding parts are designated by the same, though primed reference numerals. Hence, in connection with FIG. 2, reference can be had far-reachingly to the preceding description of FIG. 1.

A difference exists in the use of a cylindrical electrode basket 18′; the insert 8 is axially immovably secured within the main pipe 9. Another difference resides in the carburetor stock or trunk 10′ which is completely different as compared to that of FIG. 1. This carburetor trunk 10′ includes two rings of radially projecting nozzles 16′ and 36 at axially different places within the atomizing zone. An axially displaceable essentially cylindrical slide member 38 is arranged on the inside of the carburetor trunk 10′ which is adapted to be displaced downwardly by a Bowden cable 39 and is adapted to be displaced upwardly by a return spring 40. The Bowden cable 39 is extended through the apertures 42 and 43 filled out with a soft sealing mass of conventional type such as rubber, gasoline resistant soft synthetic resins, leather, felt, etc. by way of the cable roller 44 toward the outside to an adjusting motor (not shown) of conventional type. The reduced neck portion of the slide member 38, i.e., the portion with reduced diameter dimension is displaceable at will in the axial position of a nozzle ring, in which the remaining nozzle rings are then covered off by the relatively thicker portions of the slide member 38. The enlargement of the slide member 38 facing the supply side 11 is provided with an axial bore 41 so that the neck portion, i.e., the portion of reduced diametric dimension and the nozzle ring exposed thereby are connected to the gasoline supply.

It is assumed that the nozzle ring 36, compared to the nozzle ring 16', possesses the same or even a larger over-all opening cross section, but a larger number of nozzles than the other nozzle ring. A displacement or shifting of the gasoline supply from the nozzle ring 16', as illustrated, to the lower nozzle ring 36 with the finer nozzles effects under the assumption of approximately the same flow resistance as that of the other nozzle ring, an improvement of the mixture with the same mixture ratio since, in that case, not the field strength but the discharge size of the droplets determined by the nozzle size is reduced. This may be important in particular during engine starting.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An installation for producing an air/fuel mixture for a mixture-aspirating, internal combustion engine comprising air conduction channel means through which air is sucked in, fuel atomizer means having at least one fuel nozzle means terminating in the air conduction channel means and traversed by the sucked-in air, and surface means arranged in the flow path of the mixture which are at different electrical potentials, said surface means including an electrode means electrically insulated with respect to the fuel nozzle means and arranged within the fuel atomizer means at a distance from each fuel nozzle means, the electrode means being arranged for substantially surrounding the fuel nozzle means with the potential difference being applied between the electrode means and the fuel nozzle means for providing an electrostatic field surrounding the fuel nozzle means.

2. An installation according to claim 1, characterized in that the electrode means is a porous member permeable to the flow of the air.

3. An installation according to claim 2, characterized in that the electrode means is an electrode basket means arranged at a distance in front of and surrounding the nozzle means.

4. An installation according to claim 2, characterized in that a plurality of fuel nozzle means are provided in the air conduction channel means along a closed line, each nozzle means having a opening normal arranged at an angle to the inflow direction of the air.

5. An installation according to claim 4, characterized in that the nozzle means have the opening normal directed substantially radially from the inside toward the outside.

6. An installation according to claim 1, characterized in that the electrode means is permeable to the flow of the air.

7. An installation according to claim 1, characterized in that the electrode means is arranged at a distance in front of each nozzle means.

8. An installation according to claim 1, characterized in that several fuel nozzle means are provided, and the electrode means is arranged mounted electrically insulated with respect to the several fuel nozzle means at a distance from each fuel nozzle means.

9. An installation according to claim 1, characterized in that the field strength of the electrostatic field between the nozzle means and the electrode means is adjustable.

10. An installation according to claim 9, characterized in that the field strength of said electrostatic field is variable as a function of an indication of at least one operating magnitude of the engine.

11. An installation according to claim 9, characterized in that the field strength is adjustable by changing the applied potential.

12. An installation according to claim 11, with a fuel supply means, characterized in that at least two nozzle means are provided which are operable to be connected with the fuel supply means in a predetermined manner.

13. An installation according to claim 12, characterized in that two groups of nozzle means are provided.

14. An installation according to claim 13, characterized in that the groups of nozzle means are of different opening cross section.

15. An installation according to claim 14, characterized in that the nozzle means are operable to be connected additively with the fuel supply means.

16. An installation according to claim 14, characterized in that the nozzle means are operable to be connected alternatively to the fuel supply means.

17. An installation according to claim 12, characterized in that the nozzle means are of mutually different opening cross section.

18. An installation according to claim 12, characterized in that the fuel nozzle means are electrically connected with the remaining electrically conducting components of the fuel atomizer means and of the internal combustion engine so as to be at the same potential.

19. An installation according to claim 18, characterized in that several fuel nozzle means are arranged in the air conduction channel means along a closed line, whereby the opening normal of each nozzle means is arranged at an angle to the inflow direction of the air, and in that the electrode means is constructed as a flow-permeable structure extending past each nozzle means.

20. An installation according to claim 19, characterized in that the nozzle means have an opening normal directed substantially radially from the inside toward the outside.

21. An installation according to claim 20, characterized in that said nozzle means form a nozzle ring.

22. An installation according to claim 21, characterized in that said angle is an obtuse angle.

23. An installation according to claim 21, characterized in that said angle is a substantially right angle.

24. An installation according to claim 21, characterized in that said structure is an electrode basket means.

25. An installation according to claim 21, characterized in that said structure is an electrode sieve.

26. An installation according to claim 24, characterized in that the shadow surfaces of the electrode basket means are as small as possible in relation to the opening area of all meshes.

27. An installation according to claim 26, characterized in that the mesh size of the electrode basket means is essentially larger than the opening width of the nozzle means.

28. An installation according to claim 27, characterized in that the electrode basket means is so constructed and arranged relative to the nozzle ring that the opening normal of each nozzle means encounters the opening of a mesh of the electrode basket means.

29. An installation according to claim 28, characterized in that the electrode basket means is retained by way of at least one radial support arm means of electrically non-conductive material.

30. An installation according to claim 29, characterized in that several support arm means are provided.

31. An installation according to claim 29, characterized by an electrically conductive feed means between a voltage source means for the potential of the electrode basket means and the electrode basket means itself which is extended through a support arm means.

32. An installation according to claim 31, characterized in that the voltage feed means includes a shielded line.

33. An installation according to claim 32, characterized in that an ohmic resistance is connected in the voltage feed means.

34. An installation according to claim 33, characterized in that the electrode basket means is constructed cylindrically with generatrices pointing in the direction of the air flow.

35. An installation according to claim 33, characterized in that the electrode basket means is constructed at least in coarse approximation conically shaped with the cone axis disposed substantially parallel to the air flow.

36. An installation according to claim 35, characterized in that the imaginary cone apex of the electrode basket means points opposite the flow direction of the air and is arranged upstream of the nozzle ring.

37. An installation with mixture line means according to claim 31, characterized in that within the area of elbow means of the mixture line means leading to the combustion spaces of the internal combustion engine, electrode means are provided to which is applied an electric potential such that an electrostatic force acts on the droplets which is directed toward the center of the curvature.

38. An installation according to claim 37, characterized in that the field strength of said electrostatic field is variable as a function of an indication of at least one operating magnitude of the engine.

39. An installation according to claim 38, characterized in that several fuel nozzle means are provided, and the electrode means is arranged mounted electrically insulated with respect to the several fuel nozzle means at a distance from each fuel nozzle means.

40. An installation for producing an air/fuel mixture for a mixture-aspirating, internal combustion engine, which includes a fuel atomizer means equipped with at least one fuel nozzle means terminating in an air conduction channel means and traversed by the sucked-in air, and surface means arranged in the flow path of the mixture which are at different electric potentials, characterized in that an electrode means which is electrically insulated with respect to the fuel nozzle means and which forms one of said surface means, is arranged within the fuel atomizer means at a distance from each fuel nozzle means, the potential difference being applied between the electrode means, on the one hand, and the fuel nozzle means, on the other, and in that several fuel nozzle means are arranged in the air conduction channel means along a closed line, whereby the opening normal of each nozzle means is arranged at an angle now parallel to the inflow direction of the air, and in that the electrode means is constructed as a flow-permeable structure extending past each nozzle means.

41. An installation according to claim 40, with a fuel supply means, characterized in that at least two nozzle means are provided which are operable to be connected with the fuel supply means in a predetermined manner.

42. An installation according to claim 41, characterized in that the nozzle means are of mutually different opening cross section.

43. An installation according to claim 41, characterized in that the nozzle means are operable to be connected additively with the fuel supply means.

44. An installation according to claim 41, characterized in that the nozzle means are operable to be connected alternatively to the fuel supply means.

45. An installation according to claim 41, characterized in that two groups of nozzle means are provided.

46. An installation according to claim 45, characterized in that the groups of nozzle means are of different opening cross section.

47. An installation according to claim 1, characterized in that the fuel nozzle means are electrically connected with the remaining electrically conducting components of the fuel atomizer means and of the internal combustion engine so as to be at the same potential.

48. An installation according to claim 40, characterized in that the nozzle means have an opening normal directed substantially radially from the inside toward the outside.

49. An installation according to claim 40, characterized in that said nozzle means form a nozzle ring.

50. An installation according to claim 40, characterized in that said angle is an obtuse angle.

51. An installation according to claim 40, characterized in that said angle is a substantially right angle.

52. An installation according to claim 40, characterized in that the electrode means is constructed as a flow-permeable structure extending past each nozzle means.

53. An installation according to claim 52, characterized in that said structure is an electrode basket means.

54. An installation according to claim 53, characterized in that the shadow surfaces of the electrode basket means are as small as possible in relation to the opening area of all meshes.

55. An installation according to claim 53, characterized in that the mesh size of the electrode basket means is essentially larger than the opening width of the nozzle means.

56. An installation according to claim 53, characterized in that the electrode basket means is so constructed and arranged relative to the nozzle ring that the opening normal of each nozzle means encounters the opening of a mesh of the electrode basket means.

57. An installation according to claim 53, characterized in that the electrode basket means is retained by way of at least one radial support arm means of electrically non-conductive material.

58. An installation according to claim 53, characterized by an electrically conductive feed means between a voltage source means for the potential of the electrode basket means and the electrode basket means itself.

59. An installation according to claim 58, characterized in that an ohmic resistance is connected in the voltage feed means.

60. An installation according to claim 53, characterized in that the electrode basket means is constructed cylindrically with generatrices pointing in the direction of the air flow.

61. An installation according to claim 53, characterized in that the electrode basket means is constructed at least in coarse approximation conically shaped with the cone axis disposed substantially parallel to the air flow.

62. An installation according to claim 61, characterized in that the imaginary cone apex of the electrode basket means points opposite the flow direction of the air and is arranged upstream of the nozzle ring.

63. An installation with mixture line means according to claim 1, characterized in that within the area of elbow means of the mixture line means leading to the combustion spaces of the internal combustion engine, electrode means are provided to which is applied an electric potential such that an electrostatic force acts on the droplets which is directed toward the center of the curvature.

64. An installation according to claim 53, characterized by means for selectively connecting each group of nozzle means with a fuel supply.

* * * * *